United States Patent [19]

Micklitz

[11] Patent Number: 4,581,793

[45] Date of Patent: Apr. 15, 1986

[54] FUNCTIONAL DESIGN ELEMENT

[75] Inventor: Klaus Micklitz, Schwäbisch Gmünd, Fed. Rep. of Germany

[73] Assignee: Schleich GmbH & Co. KG, Fed. Rep. of Germany

[21] Appl. No.: 673,651

[22] Filed: Nov. 21, 1984

[30] Foreign Application Priority Data

Nov. 25, 1983 [DE] Fed. Rep. of Germany ..... 3342718

[51] Int. Cl.[4] ..... A63H 33/04; E04F 19/00

[52] U.S. Cl. ..... 24/697; 24/297; 446/95; 446/113; 446/121

[58] Field of Search ..... 24/297, 697, 698, 701, 24/702; 446/95, 121, 113; 312/111

[56] References Cited

U.S. PATENT DOCUMENTS

| | | | |
|---|---|---|---|
| 1,648,706 | 11/1927 | Walker | 446/113 |
| 2,709,290 | 5/1955 | Rosenthal | 24/697 |
| 2,885,822 | 5/1959 | Onanian | 446/121 |
| 3,037,596 | 6/1962 | Fordyce | 24/297 |
| 3,393,933 | 7/1968 | Cornelius | 312/111 |
| 3,475,794 | 11/1969 | Seckerson | 24/297 |
| 3,897,967 | 8/1975 | Barenyi | 24/297 |
| 4,037,978 | 7/1977 | Connelly | 446/113 |
| 4,074,465 | 2/1978 | Bright | 24/297 |
| 4,170,083 | 10/1979 | Freelander et al. | 446/95 |
| 4,485,531 | 12/1984 | Murphy | 24/297 |

FOREIGN PATENT DOCUMENTS

| | | | |
|---|---|---|---|
| 1384385 | 11/1964 | France | 24/297 |
| 312587 | 3/1956 | Switzerland | 446/113 |
| 415250 | 8/1934 | United Kingdom | 446/113 |
| 745788 | 2/1956 | United Kingdom | 24/297 |
| 883895 | 12/1961 | United Kingdom | 446/113 |

*Primary Examiner*—Victor N. Sakran

*Attorney, Agent, or Firm*—Ratner & Prestia

[57] ABSTRACT

A functional design element for use with a toy or toy-like assembly set comprises a substantially rectangular material strip being formed with two openings at its opposed longitudinal ends for two push-button-like fasteners whereby the material strip is formed either of a resiliently pliable or of a rigid synthetic resin within two respective groups of different functional design elements for obtaining technical-functional and at the same time esthetical different impressions for the visible surface of the assembled design body.

14 Claims, 8 Drawing Figures

FIG. 1
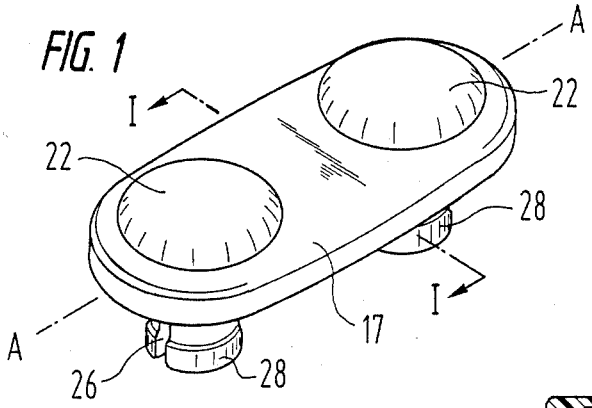
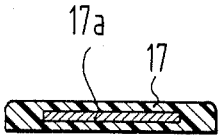
FIG. 1a
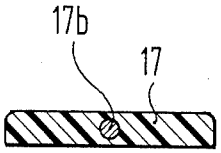
FIG. 1b
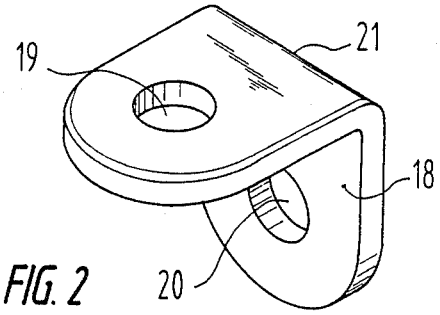
FIG. 2
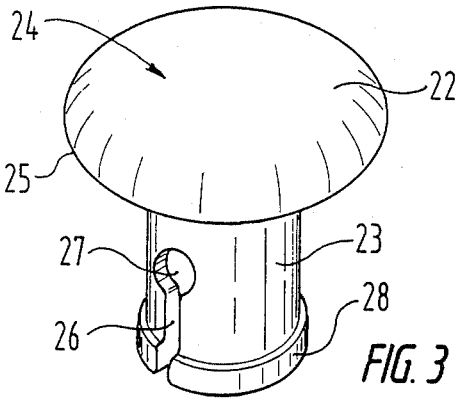
FIG. 3

FUNCTIONAL DESIGN ELEMENT

FIELD OF THE INVENTION

This invention relates to a functional design element for use with a toy or toy-like assembly set.

BACKGROUND ART

All of the prior art toy or toy-like assembly sets of the kind as herein referred usually comprise a plurality of three dimensional members formed of a synthetic resin with different geometric configurations. These members are further provided with integrated attachment means such as projecting pins and corresponding plug-in holes or even more simply with flat surfaces for an interconnection of these members then by means of an adhesive in such a manner as to allow the children an easy assembly of the design body. In more complicated assembly sets there are usually provided respectively more complicated and mostly more technical attachment means for the interconnection of such individual constructional members especially in case of design bodies simulating more technical prototypes on a respectively reduced scale and then also corresponding in every detail more or less in a technical-functional manner with the original prototype. Such more complicated design bodies then also comprise for example attachment means simulating the existence of joints or hinges for the assembly of relatively movable members. They also may comprise attachment means which under consideration of the different geometric configurations of the individual members of the assembly set will allow in a more complicated programmed manner a bridging of differently shaped partitions for a rigid interconnection of two members thereby also in such a manner as to provide more or less a technical-functional equivalence with any original prototype.

A less complicated toy assembly set as shown in U.S. Pat. No. 4,170,083 utilizes a plurality of flexible strips which are adapted to interconnect with base members in such a manner as to form a wide variety of assembled design bodies from a relatively small number of different construction members. Each flexible strip is provided along its longitudinal axis with two spaced openings of such a size as to allow a frictional interfitting of both ends of each flexible strip over one of a plurality of integrated projections of the construction members for obtaining an overlying relation relative thereto. A further known toy assembly set as shown in U.S. Pat. No. 2,885,822 utilizes push-button-like fasteners for a relatively rigid interconnection of two construction members whereby each fastener has a head portion and a shaft portion of a respective diameter larger and smaller than the diameter of matching through holes in said constructional members. The massive shaft portion of these fasteners is further provided with an expansion slit and an axial length larger than the common thickness of the two thereby rigidly assembled constructional members which are held together through a co-operation of the head portion and a thicker shaft end the two halves of which are spreaded apart by said expansion slit as soon as a fastener has been inserted into the matching holes. In the U.S. Pat. No. 1,648,706 there is finally shown also a toy assembly set which utilizes flat constructional members being each provided with a plurality of openings as arranged with an equal spacing and which further utilizes rectangular flat or angular irons each being provided with two openings of the same spacing to thereby allow an assembly of the constructional members by means of srews and wing nuts.

This invention deals with the object of providing a functional design element which when untilized for a toy or toy-like assembly set mainly for children between 5 and 12 years of age will allow a more flexible assembly of the individual three-dimensional members under the viewpoint of a less perfect simulation of an original prototype with the assembled design body with respect to its technical-functional and at the same time its esthetic impression.

This object of the present invention is accomplished by principally providing a joining strip which by means of two push-button-like fasteners may be attached to two different members of the assembly set to either obtain a relatively movable assembly in the manner of a hinge or to thereby obtain a visible bridging of a partition between two relatively rigid assembled members. The functional design elements according to the present invention appear on the readyly assembled design body as less perfect technical-functional elements and rather dominate as esthetic additions of the design body which are provided in a manner of a rather amateurish and childlike immitative instinct with respect to a corresponding original prototype of the assembled design body. The functional design element of the present invention therefore may be utilized not only for assembly sets of toys but also of toy-like design bodies being usable as gift or advertising articles.

BRIEF DESCRIPTION OF THE DRAWINGS

FIG. 1 is a perspective view of a functional design element according to the present invention;

FIG. 1*a* and 1*b* are cross-sections along line I—I in FIG. 1 of the material strip according to two alternate embodiments;

FIG. 2 is a perspective view of the material strip according to further alternate embodiments.

FIG. 3 is a perspective view of a push-button-like fastener of the functional design element according to FIG. 1;

FIG. 4*a* is a sectional view taken along line IV—IV in FIG. 4; and

DESCRIPTION OF THE INVENTION

Figure 4A:
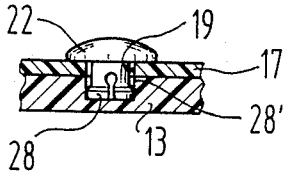
FIG. 4*a* is a perspective view of an assembled design body in the form of a toy vehicle and utilizing a plurality of functional design elements of two main groups as provided by the present invention.
Figure 4:
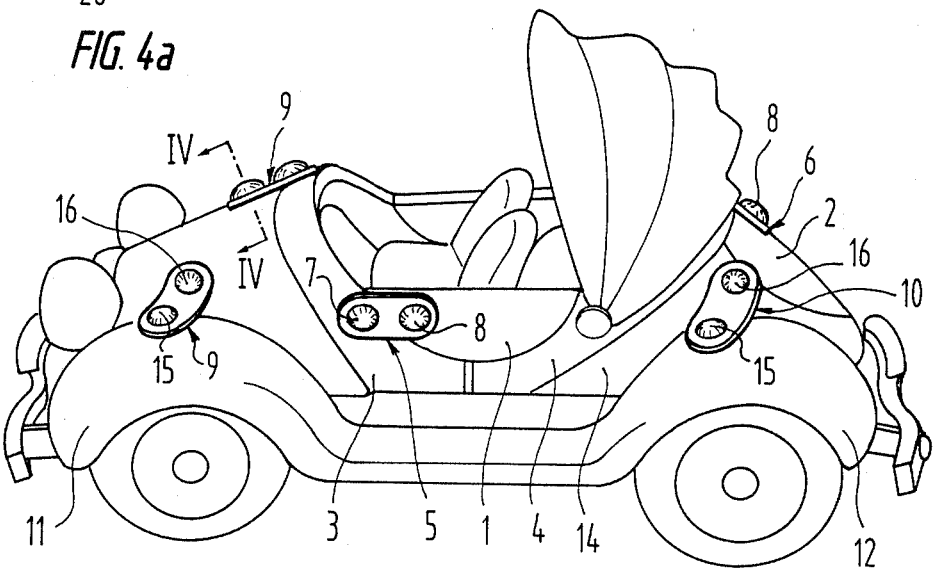

Referring to FIG. 4, one form of an assembled design body in the form of a toy vehicle is shown which comprises a plurality of interconnected three-dimensional members of a respective assembly set. All of the design members are formed of a synthetic resin of preferably different hardness and also preferably of a different colour with a thickness between 3 mm and 5 mm. The visible surface of these members should be made lustreless or granulated to thereby obtain an individualized impression of the assembled design body. Except for the following inventive particularities all of these members are assembled by simple integrated pin-and-hole attachment means at hidden sites or alternatively by means of any suitable adhesive as applied on matching surfaces at the partition of two adjacent members.

The relative movably assembled members designed as doors 1 and rear trunk lid 2 of the shown toy vehicle are each connected with an adjacent body member 3,4 by means of a joining strip 5,6 and two push-button-like fasteners 7,8. Further joining strips 9,10 are provided for bridging partitions that are present between relatively rigid assembled further body members 11,13 and 12,14. These further joining strips 9,10 are as well attached to the visible surface of the toy vehicle by means of push-button-like fasteners 15,16 as arranged on both sides of the respective partition.

The joining strips 5,6 and 9,10 as well as the fasteners 7,8 and 15,16 commonly form the inventive functional design element of FIG. 1. This functional design element comprises a substantially rectangular material strip 17 of a uniform thickness which along its longitudinal axis A—A is formed with two equally sized circular openings at its opposed longitudinal ends for allowing the insertion of a fastener in accordance with the design of FIG. 3. For the provision of the joining strips 5,6 this material strip 17 is formed in a respective first group of such functional design elements of a synthetic resin which is resiliently pliable at least at the central strip portion intermediate its two openings. Alternatively the material strip of such a first group of design elements may entirely be formed of a pliable synthetic resin and then be provided in the portion intermediate its openings either with an embedded flexible sheet core 17*a* or an embedded flexible wire core 17*b* as known from flexible figure toys. For the provision of the joining strips 9,10 this material strip 17 is formed on the other side in a respective second group of functional design elements of a synthetic resin which is rigid or extensible along the longitudinal axis A—A of the strip. Alternatively the material strip of this second group of functional design elements may as well comprise an embedded sheet core 17*a* or wire core 17*b*.

With such different materials for the material strip 17 of such two different groups of functional design elements the individual design members of the assembly set may accordingly be assembled in pairs either relatively movable or relatively rigid. The functional design elements therefore simulate on the visible surface of the assembled design body the functional presence either of hinges or of rigid interconnections bridging the partitions between two adjacent design members to thereby individualize the esthetic impression of the design body as shown in FIG. 4. This impression may find an overemphasis by providing the material strip 17 with a colour such as especially the black colour different from the colours of the individual design members.

For other assembly sets there may be provided still further groups of functional design elements with a material strip 18 as shown in FIG. 2. This material strip 18 is also provided with a substantially rectangular shape and formed of a synthetic resin which is rigid along the longitudinal axis of the strip. At its two opposed ends the material strip 18 is formed with two corresponding circular openings 19,20 and a permanent bending edge 21 transverses the longitudinal axis under a right angle intermediate these openings. With such a material strip 18 there are accordingly provided angular functional design elements of which the material strip is bent at this bending edge 21 with a right angle or for the provision of still further alternate embodiments with a different angle whereby the two legs of such an angular material strip 18 being formed with the openings 19,20 may also be provided with different lengths.

The two push-button-like fasteners of each functional design element are as well formed of a synthetic resin and comprise as shown in FIG. 3 a head portion 22 and a shaft portion 23. The head portion 22 is provided with a convex face 24 and a rounded edge 25 in the transition to a flat back serving as a contact surface for the head portion in respect to the material strip 17,18. The shaft portion 23 is hollow and provided with an expansion slit 26 at its free end. The expansion slit 26 is provided at its inner end with an enlargement 27 to thereby improve the flexibility of the shaft portion 23 with respect to a collar 28 that is provided at the free end of the shaft portion. The shaft portion 23 has a length slightly larger than the thickness of the material strip 17,18 so that with a diameter of this shaft portion as at the same time adapted to the diameter of the circular openings of the material strip each fastener may be held on the material strip 17,18 of each functional design element as shown in FIG. 1 through the co-operation of its head portion 22 and this particular collar 28. The functional design elements may therefore be attached to the design members of the assembly set by an insertion of this collar 28 into a shallow plug-in hole 28' by a finger pressure on the head portion 22 of each fastener whereby the expansion slit 26 secures a relatively fast interference fit. Because this interference fit is only obtained by means of the collar 28 it will be on the other side most easy to loosen again the attachment of the functional design element especially in that case when the head portion of each fastener is formed of a synthetic resin which is more resiliently pliable than the respectively more rigid shaft portion to thereby allow a more easy initiation of this loosening at the rounded edge 25 of the head portion.

The push-button-like fasteners may alternatively be also provided with a massive shaft portion to thereby provide a flat or slightly concave face for an adhesive attachment of the functional design elements to the visible surface of the design members. In such a case the visible surface of the design members not necessarily must be provided with corresponding shallow plug-in holes so that the functional design elements may then find an attachment also at any arbitrary spot of the visible surface to thereby further individualize the esthetic impression of the design body.

Figure 5:
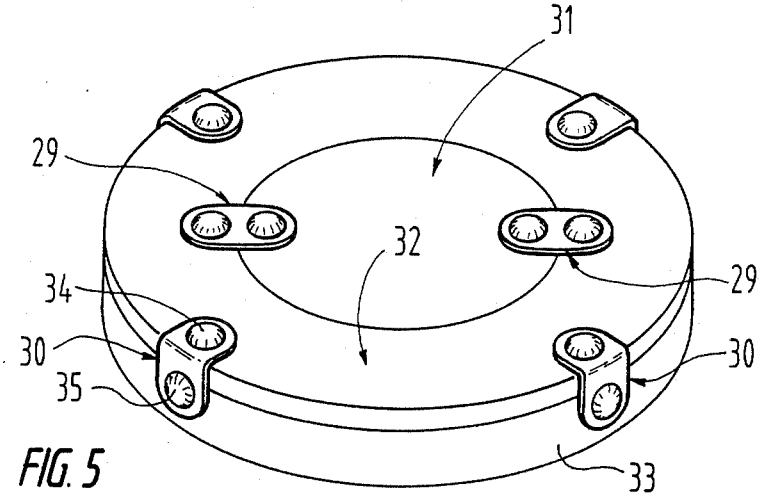
FIG. 5 is a perspective view of an assembled design body formed as a gift box.

The inventive functional design elements as above described are mainly conceived for toy assembly sets for children between 5 and 12 years of age. As auxiliary means for technical-functionally and at the same time esthetically influencing the impression of any respectively assembled design body these functional design elements may as well be used for respective assembly sets of similar gift or advertising articles such as for example the box as shown in FIG. 5. This box is as well provided with corresponding material strips 29,30 as attached to design members 31,32 and 32,33 by means of push-button-like fasteners 34,35 which in case of the material strips 29 are inserted with their shaft portion into a shallow plug-in hole whereas in case of the material strips 13 the shaft portion of these fasteners is glued at a flat or slightly concave face to the visible surfaces of the design members 32,33. The design member 31 forming a lid of this box may therefore by clapped upwardly with one of the material strips 29 as a hinge when this material strip is formed as the joining strips 5,6 of the toy vehicle as shown in FIG. 4 of a resiliently pliable synthetic resin and when the interference fit of at least one fastener of the second material strip 29 has been loosened. Although the fasteners of the material strips 30 could as well be provided with a respective insertion fit in shallow plug-in holes their adhesive attachment is preferred in this case for the reason to thereby increase the flexibility of the final design since it thereby will for example be possible to find for the attachment of these material strips a different arrangement over the circumference of the box, or find it even acceptable to not at all attach these material strips to the box.

What is claimed is:

1. A functional design element for use with a toy or toy-like assembly set, comprising a plurality of three-dimensional members formed of a synthetic resin with different geometric configurations and attachment means for interconnecting these members in such a manner as to obtain relatively movable and relative rigid portions for the assembled design body, the functional design element being utilized for such an assembly set in a specific design plurality and comprising:

a substantially rectangular material strip of a uniform thickness having two equally sized circular openings at its opposed longitudinal ends;

two push-button-like fasteners having each a head portion and a shaft portion of respective diameters larger and smaller than the diameter of said openings, the head portion being provided with a convex face and a flat back, and the shaft portion being provided with a length equal to or slightly larger than the thickness of said material strip to thereby allow the strip to be attached by means of these fasteners to the visible face of said members either by means of an adhesive as applied to the end face of the shaft portion or by an insertion of the shaft portion into shallow plug-in holes of said members;

the material strip when being utilized for the relative movable assembly of a member of said assembly set being formed in a respective first group of functional design elements of a synthetic resin which is resiliently pliable at least at the central strip portion intermediate said openings;

the material strip when being utilized for the relative rigid assembly of another member of said assembly set being formed in a respective second group of functional design elements of a synthetic resin which is rigid or extensible along the longitudinal axis of the material strip.

2. The functional design element of claim 1, said material strip being formed in a third group of functional design elements of a synthetic resin which is rigid along the longitudinal axis of the strip and the strip being provided with a permanent bending edge which transverses the longitudinal axis under a right angle intermediate said two openings.

3. The functional design element of claim 2, wherein the material strip is bent at said bending edge with a right angle.

4. The functional design element of claim 1, said material strip at least of said first group of design elements being entirely formed of a pliable synthetic resin and being provided in the portion intermediate its two openings with an embedded flexible sheet core or an embedded flexible wire core extending along the longitudinal axis.

5. The functional design element of claim 1, said shaft portion of each fastener being hollow and provided with an expansion slit at its free end.

6. The functional design element of claim 1, said shaft portion of each fastener being provided at its free end with a collar of such a size as to either provide a respectively enlarged flat or slightly concave face for the application of an adhesive or to allow an interference fit for its insertion into a shallow plug-in hole.

7. The functional design element of claim 1, said head portion of each fastener being provided with a rounded edge in the transition from its face to its back and being formed of a synthetic resin which is more resiliently pliable than the respectively more rigid shaft portion.

8. In a toy assembly having a plurality of three-dimensional members formed of a synthetic resin with different geometric configurations, attachment means for interconnecting said members comprising:

a first plurality of substantially rectangular material strips each of a uniform thickness and having two equally sized circular openings at opposed longitudinal ends, each of said strips of said first plurality being formed of a synthetic resin which is resiliently pliable at least at the central strip portion intermediate said openings;

a second plurality of substantially rectangular material strips each of a uniform thickness and having two equally sized circular openings at opposed longitudinal ends, each of said strips of said second plurality being formed of a synthetic resin which is rigid or extensible along the longitudinal axis of said strip;

and a plurality of push-button-like fasteners each having a head portion and a shaft portion of respective diameters larger and smaller than the diameters of said openings in said strips, the head portions being provided with a convex face and a flat back, and the shaft portions being provided with a length equal to or slightly larger than the thicknesses of said material strips to thereby allow said strips to be attached by means of said fasteners to the visible faces of said three-dimensional members either by means of an adhesive as applied to the end faces of said shaft portions or by insertion of said shaft portions into shallow plug-in holes of said three-dimensional members, thereby producing relatively movable interconnections between said three-dimensional members attached together by strips of said first plurality and relatively rigid interconnections between said three-dimensional members attached together by strips of said second plurality.

9. Attachment means according to claim 8 further including a third plurality of material strips each of a uniform thickness and having two equally sized circular openings at opposed longitudinal ends, each of said strips of said third plurality being formed of a synthetic resin which is rigid along the longitudinal axis of said strip and having a permanent bending edge which transverses said longitudinal axis under a right angle intermediate said two openings.

10. Attachment means according to claim 9 wherein each of said material strips of said third plurality is bent at said bending edge with a right angle.

11. Attachment means according to claim 8 wherein each of said material strips of at least said first plurality is formed entirely of a pliable synthetic resin and is provided in the portion intermediate said openings with an embedded flexible sheet core or an embedded flexible wire core extending along said longitudinal axis.

12. Attachment means according to claim 8 wherein said shaft portion of each fastener is hollow and provided with an expansion slit at its free end.

13. Attachment means according to claim 8 wherein said shaft portion of each fastener is provided at its free end with a collar of such a size as to either provide a respectively enlarged flat or slightly concave face for the application of an adhesive or to allow an interference fit for its insertion into a shallow plug-in hole.

14. Attachment means according to claim 8 wherein said head portion of each fastener is provided with a rounded edge in the transition from its face to its back and is formed of a synthetic resin which is more resiliently pliable than the respectively more rigid shaft portion.

* * * * *